US006679001B1

(12) United States Patent
Guelck

(10) Patent No.: US 6,679,001 B1
(45) Date of Patent: Jan. 20, 2004

(54) WINDOW SYSTEM WITH LOCKING DEVICE

(75) Inventor: Volker Guelck, Waterloo (CA)

(73) Assignee: Crystal Window & Door Systems, Ltd., Flushing, NY (US)

( * ) Notice: Subject to any disclaimer, the term of this patent is extended or adjusted under 35 U.S.C. 154(b) by 0 days.

(21) Appl. No.: 10/186,041

(22) Filed: Jun. 28, 2002

(51) Int. Cl.[7] ..... E05D 15/22
(52) U.S. Cl. ..... 49/183
(58) Field of Search ..... 49/183, 184, 185

(56) References Cited

U.S. PATENT DOCUMENTS 5,398,447 A * 3/1995 Morse ..... 49/185
5,791,700 A * 8/1998 Biro ..... 292/7
5,992,907 A * 11/1999 Sheldon et al. ..... 292/34
6,141,913 A * 11/2000 Wong et al. ..... 49/465

* cited by examiner

*Primary Examiner*—Jerry Redman
(74) *Attorney, Agent, or Firm*—Collard & Roe, P.C.

(57) ABSTRACT

A window system comprises a frame having a top, a bottom and two sides, at least one slidable and tiltable sash disposed within the frame, and a locking device attached to each side of the sash. The locking device is pivotable between an unlocked position to permit tilting of the sash, and a locked position which locks the sash to the frame. In the locked position, the locking device prevents any air from infiltrating between the sides of the sash and the frame.

7 Claims, 5 Drawing Sheets

WINDOW SYSTEM WITH LOCKING DEVICE

BACKGROUND OF THE INVENTION

1. Field of the Invention

The invention relates to a window system having a novel locking device. In particular, the invention relates to a double-hung type window that has a locking device disposed along both sides of each of the sashes. The locking device prevents the sashes from bending away from the window frame and prevents infiltration of air through the gap between the sash and frame.

2. The Prior Art

Traditional double-hung windows consist of a window frame and two sashes, which slide up and down within grooves on the frame. Many of these windows can also be tilted inward, for ease of cleaning. Since these tiltable windows are only connected to the frame at bottom and top portions, a gap can form between the sides of the sash and the sides of the frame, through which air can infiltrate. This is especially true during high winds, when the wind can bend the sashes inward and increase the size of the gap.

SUMMARY OF THE INVENTION

It is therefore an object of the invention to provide a double hung window that can be easily tilted for cleaning, but does not let air infiltrate through the sides of the sashes.

It is another object of the invention to provide a window system that is simple to manufacture and operate.

These and other objects of the invention are provided by a window system comprising a frame having a top, a bottom and two sides, at least one slidable and tiltable sash disposed within the frame, and a locking device attached to each side of the sash. The locking device is pivotable between an unlocked position to permit tilting of the sash, and a locked position which locks the sash to the frame. In the locked position, the locking device prevents any air from infiltrating between the sides of the sash and the frame.

The frame has an elongated recess extending along each side. The locking device comprises an elongated flange having one end connected along the entire side of the sash. The other end of the flange is free and pivots outward in the locked position to fit within the recess of the frame, to prevent any air from infiltrating between the sash and frame. The locking device is held in a locked position by at least one spring connected to the sash and locking device. The spring pushes the locking device outwards, so it naturally rests in the locked position. The spring can be any type of spring, such as a leaf spring, coil spring or wire spring, but a coil spring is preferred. Alternatively, foam or other compressible material could also be used.

There is a latch on a top part of each sash, for allowing the sash to tilt within the frame. The latch has a locked and unlocked position, so that in the locked position the sash is prevented from tilting within the frame and in the unlocked position, the sash may tilt. The locking device is connected to the latch via a connecting device such as a screw, so that when the latch is moved into the locked position, the locking device is also moved into the locked position, and when the latch is unlocked, the locking device is unlocked as well. Thus, no additional efforts are required by the user to activate the locking device apart from the latch. As an alternative to the screw, a pin or wire or any other suitable connecting device may also be used.

To prevent the locking device from pivoting too far outward, there is a protrusion on the free end of the locking device, and a stop on the sash, so that when the locking device pivots into the locked position, the protrusion contacts the stop and prevents over-pivoting of the locking device.

The locking device is preferably made of aluminum, but other materials could also be used. The locking device can be used on a variety of different windows: double hung, single hung and sliding windows. With double hung windows, the locking device runs vertically along the sides of the window. With a sliding window, the locking device runs horizontally along the top and bottom sides of the window.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Referring now in detail to the drawings and, in particular, FIGS. 1–4 show various views of a window 10 comprising a frame 20, upper sash 30 and lower sash 40. Sashes 30, 40 have glass panels. 31, 41, respectively.

Figure 4:
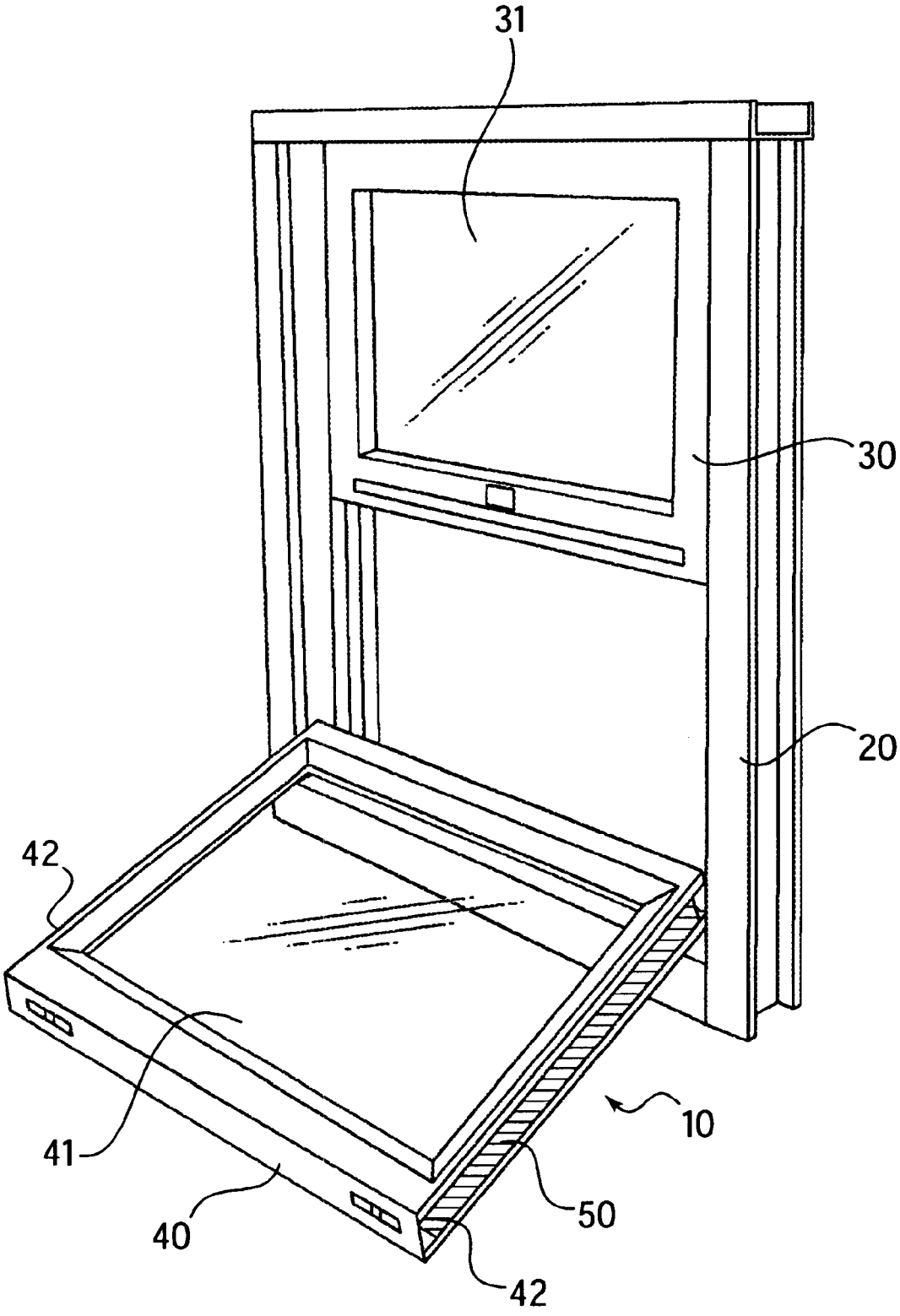
FIG. 4 shows a perspective view of a window according to the invention with the lower sash in a tilted position.

Attached to sides 42 of sash 40 is a locking device 50, which is pivotally attached to sides 42 via a screw 51. Locking device 50 is elongated and extends the length of side 42, as shown in FIG. 4. Locking device 50 is preferably made of aluminum, but can also be made of other materials. Locking device 50 pivots between a locked position, shown in FIG. 1, and an unlocked position, shown in FIG. 2. In the locked position, locking device extends partway into recess 21 of frame 20, thus preventing any air from infiltrating between frame 20 and sides 42 of sash 40. Locking device 50 also prevents any inadvertent tilting of sash 40. Locking device 50 is maintained in locked position by a spring 55, which presses on a free end of locking device 50 to push it into recess 21.

Figure 5:
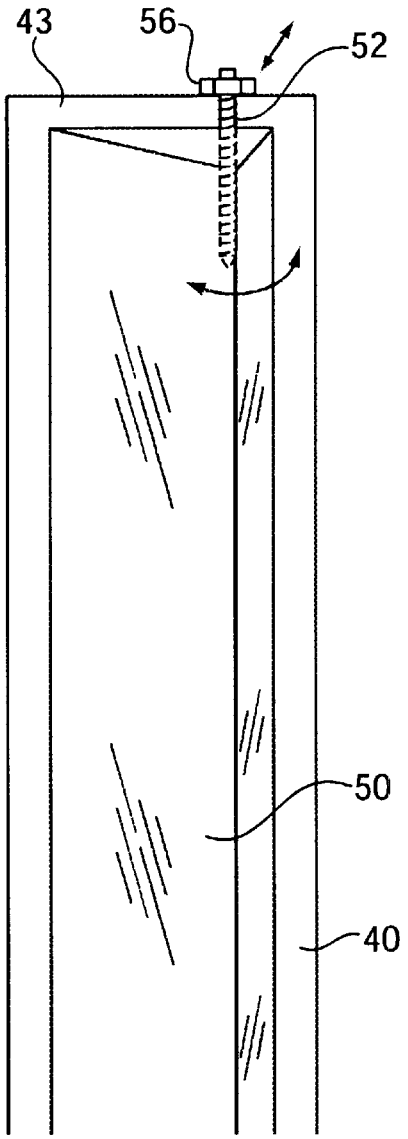
FIG. 5 shows a side view of a sash of the window according to the invention, with the locking device in the locked position.
Figure 6:
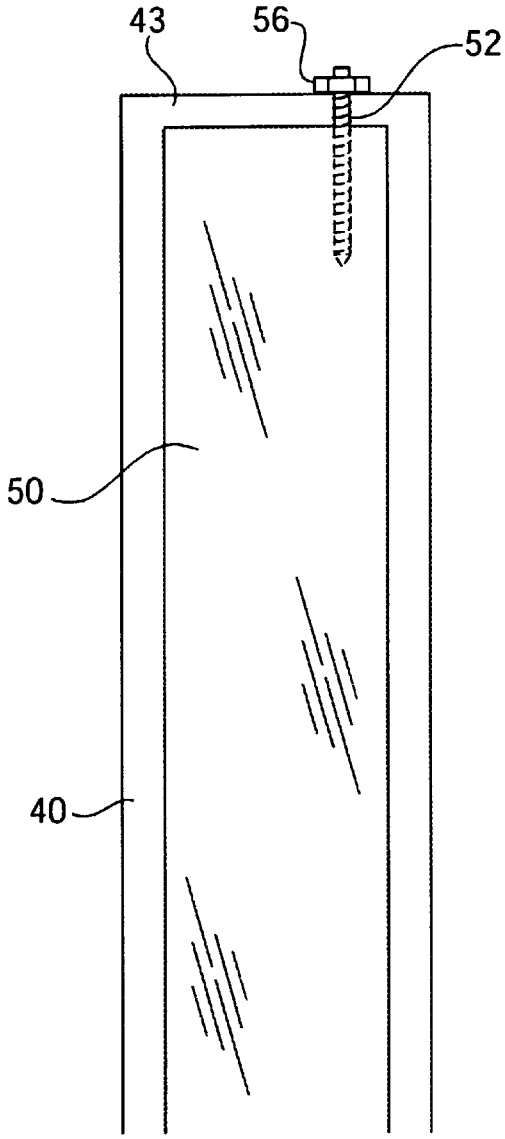
FIG. 6 shows a side view according to FIG. 5 with the locking device in the unlocked position.

To move locking device 50 between the locked and unlocked position, a screw 52 is connected to the free edge 53 of locking device 50. Screw 52 is connected to a latch 56, located on a top side 43 of sash 40, as shown in FIGS. 5 and 6. To pivot locking device 50, latch 56 is slid back and forth, which causes screw 52 to pivot locking device 50. Thus, locking device 50 is engaged simply by moving latch 56. Therefore, no additional effort is required to engage locking device 50. When latches 56 are not pulled into an unlocked position, locking device 50 rests in the locked position, under pressure from springs 55. Springs 55 can be any type of spring, such as a coil spring, leaf spring, wire spring, etc.

Figure 1:
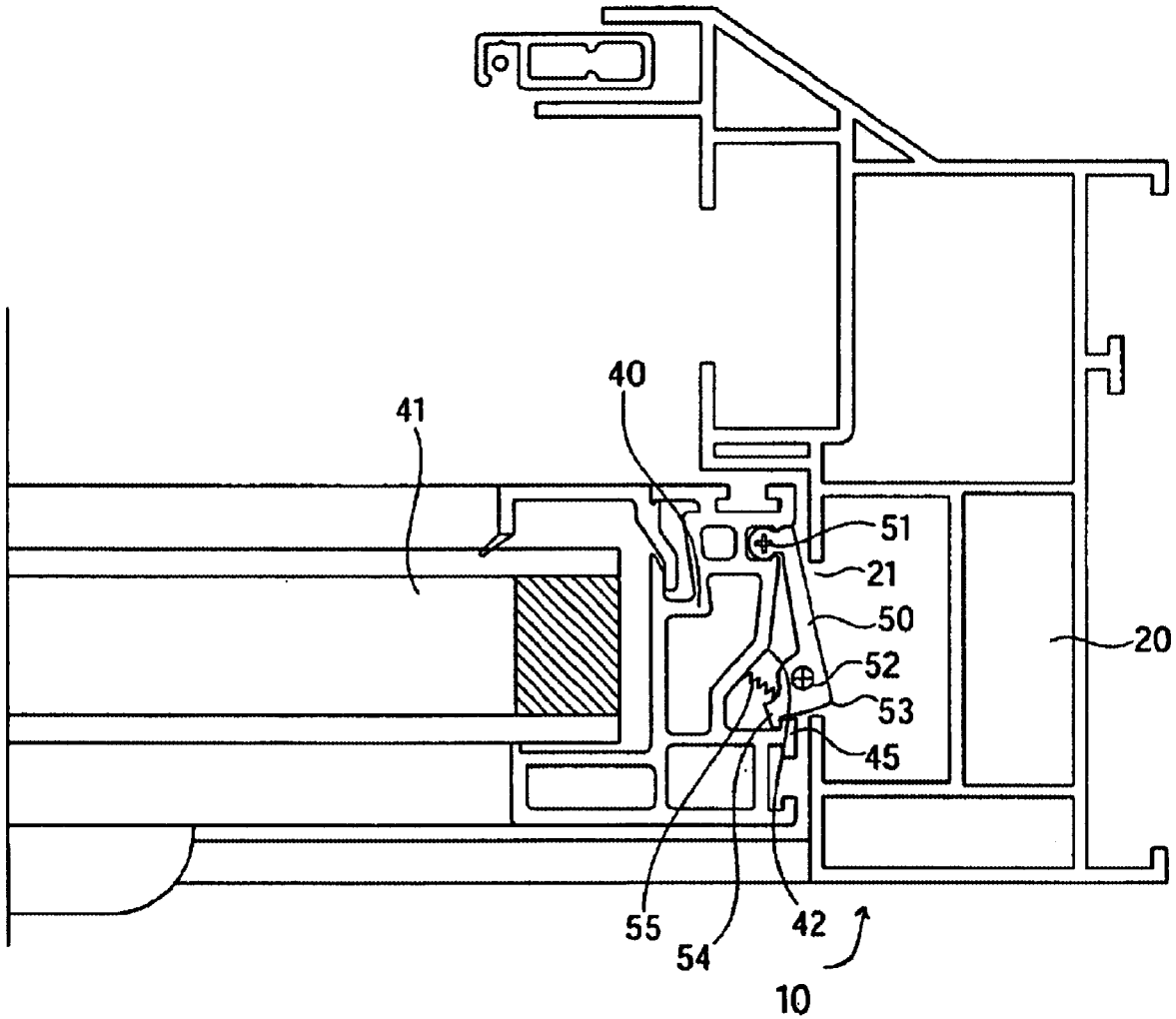
FIG. 1 shows a horizontal cross-sectional view of a portion of a window according to the invention with the locking device in the locked position.
Figure 2:
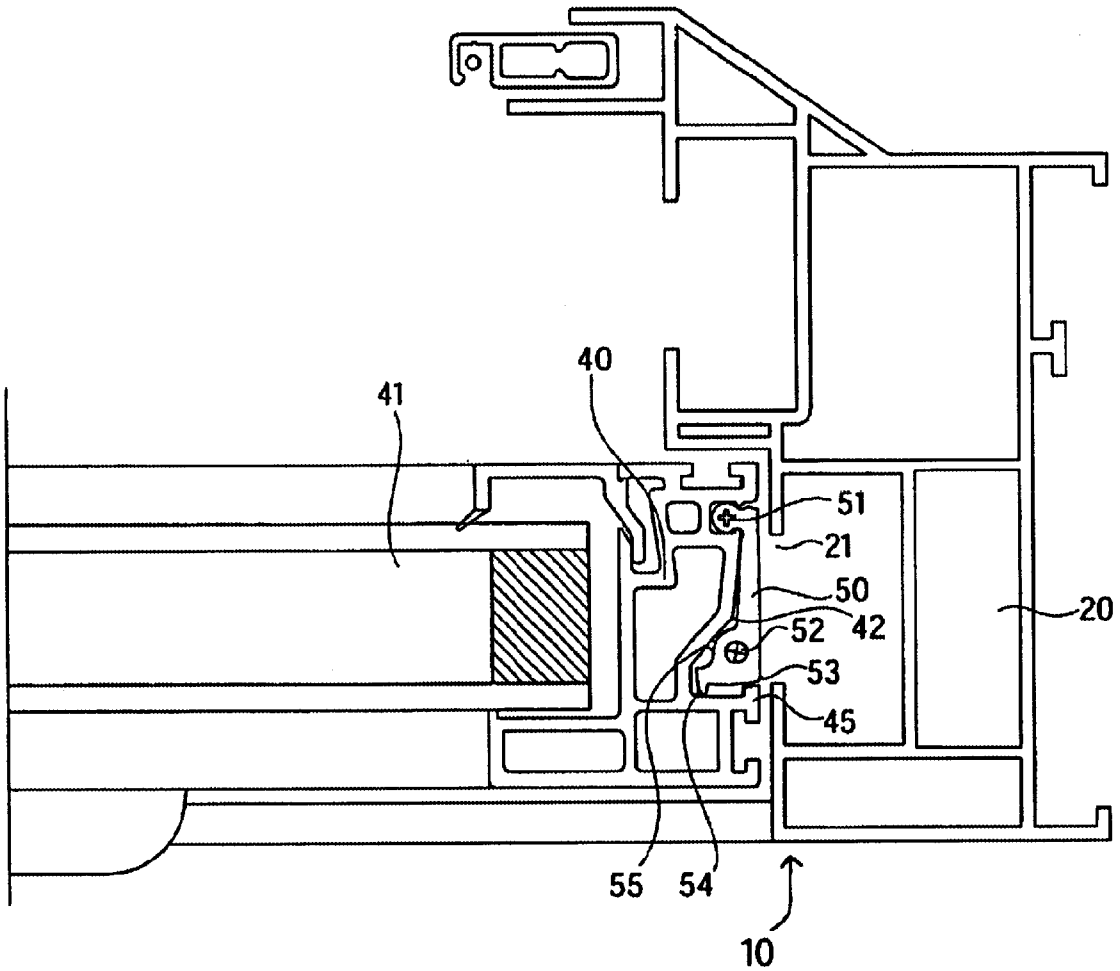
FIG. 2 shows a horizontal cross-sectional view according to FIG. 1 with the locking device in the unlocked position.
Figure 3:
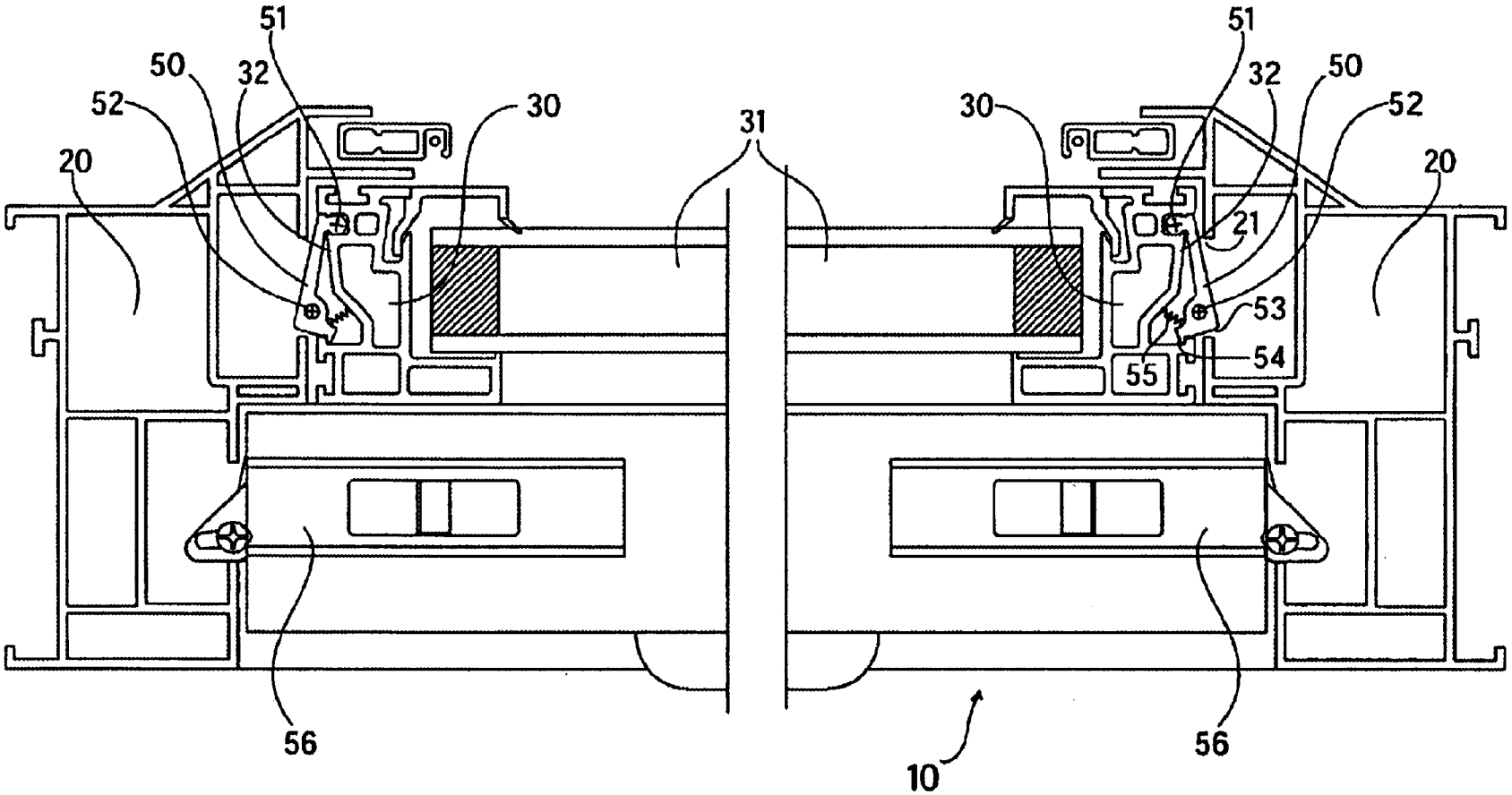
FIG. 3 shows a horizontal cross-sectional view of a double-hung window according to the invention.

To prevent locking device 50 from over-pivoting and extending too far into recess 21, a protrusion 54 is located on the free end 53 of locking device 50. Protrusion 54 abuts a flange 45, located on sash 40, to prevent any further movement of locking device 50, when locking device 50 is moved into the unlocked position, as shown in FIG. 2. While a description of locking device 50 has been given only with respect to sash 40, it is also envisioned that locking device 50 is also attached to sash 30 as well, in the same manner described above.

Accordingly, while only a single embodiment of the present invention has been shown and described, it is obvious that many changes and modifications may be made thereunto without departing from the spirit and scope of the invention.

What is claimed is:

1. A window system comprising:

a frame having a top, a bottom, two sides and at least one elongated recess extending along at least one of said two sides of said frame;

at least one slidable and tiltable sash disposed within said frame, said slidable and tiltable sash having two opposing sides; and a locking device attached to at least one of said two opposing sides of said at least one slidable and tiltable sash, said locking device being pivotable between an unlocked position to permit tilting of said slidable and tiltable sash, and a locked position which locks said slidable and tiltable sash to said frames;

wherein said locking device comprises an elongated flange having one end connected along substantially an entire length of a side of the slidable and tiltable sash and having a free end, the free end of said elongated flange pivoting outward in the locked position to fit within said elongated recess; and wherein said locking device prevents bending of said slidable and tiltable sash and prevents air from infiltrating between said frame and said slidable and tiltable sash.

2. The window system according to claim 1, wherein said locking device is held in a locked position by at least one spring connected to said slidable and tiltable sash and said locking device.

3. The window system according to claim 2, wherein said at least one spring is selected from the group consisting of leaf springs, coil springs and wire springs.

4. The window system according to claim 1, further comprising a latch on a top part of said slidable and tiltable sash, said latch having a locked and unlocked position, wherein in the locked position said slidable and tiltable sash is prevented from tilting within said frame and in the unlocked position, said slidable and tiltable sash may tilt, and further comprising a device for connecting said locking device to said latch so that moving said latch into the unlocked position also moves said locking device into the unlocked position.

5. The window system according to claim 4, wherein said device for connecting said locking device to said latch is a screw.

6. The window system according to claim 1, further comprising a protrusion on a free end of said locking device, and a stop on said slidable and tiltable sash, so that when said locking device pivots into the locked position, said protrusion contacts said stop and prevents over-pivoting of said locking device.

7. The window system according to claim 1, wherein said locking device is made of aluminum.

* * * * *